United States Patent [19]

Strickland et al.

[11] 4,044,986

[45] Aug. 30, 1977

[54] CONCRETE FORM PANEL TYING APPARATUS

[75] Inventors: James K. Strickland; Frank R. Capps, both of Jacksonville; Todd B. Nekola, South Ponte Vedra Beach; William A. Fremer, St. Petersburg, all of Fla.

[73] Assignee: Strickland Systems Inc., Jacksonville, Fla.

[21] Appl. No.: 576,862

[22] Filed: May 12, 1975

[51] Int. Cl.[2] ..... E04G 17/08

[52] U.S. Cl. ..... 249/216; 249/42; 249/46; 249/219 R

[58] Field of Search ..... 249/40–46, 249/190–191, 213–214, 216–217, 219 R

[56] References Cited

U.S. PATENT DOCUMENTS

| | | | |
|---|---|---|---|
| 2,172,461 | 9/1939 | Whitescarver | 249/213 |
| 2,502,672 | 4/1950 | Roother | 249/42 |
| 2,659,125 | 11/1953 | Williams | 249/42 |
| 2,967,689 | 1/1961 | Jahn | 249/219 W |
| 3,010,175 | 11/1961 | Shoemaker | 249/45 |
| 3,357,672 | 12/1967 | Capek | 249/216 |
| 3,633,867 | 1/1972 | Eriksson | 249/42 |
| 3,693,931 | 9/1972 | Holt | 249/46 |
| 3,984,079 | 10/1976 | Gates | 249/190 |

*Primary Examiner*—Francis S. Husar
*Assistant Examiner*—John McQuade
*Attorney, Agent, or Firm*—Schuyler, Birch, Swindler, McKie & Beckett

[57] ABSTRACT

Apparatus for tying together concrete form panels includes an elongated tie and means attachable to a concrete form panel for anchoring the tie to restrain relative movement between the tie and the form panel. Means are provided both to facilitate engagement and release of the tie by the clamping member and to compensate for misalignment between the tie and the form panel and between opposing form panels.

39 Claims, 29 Drawing Figures

FIG. 5
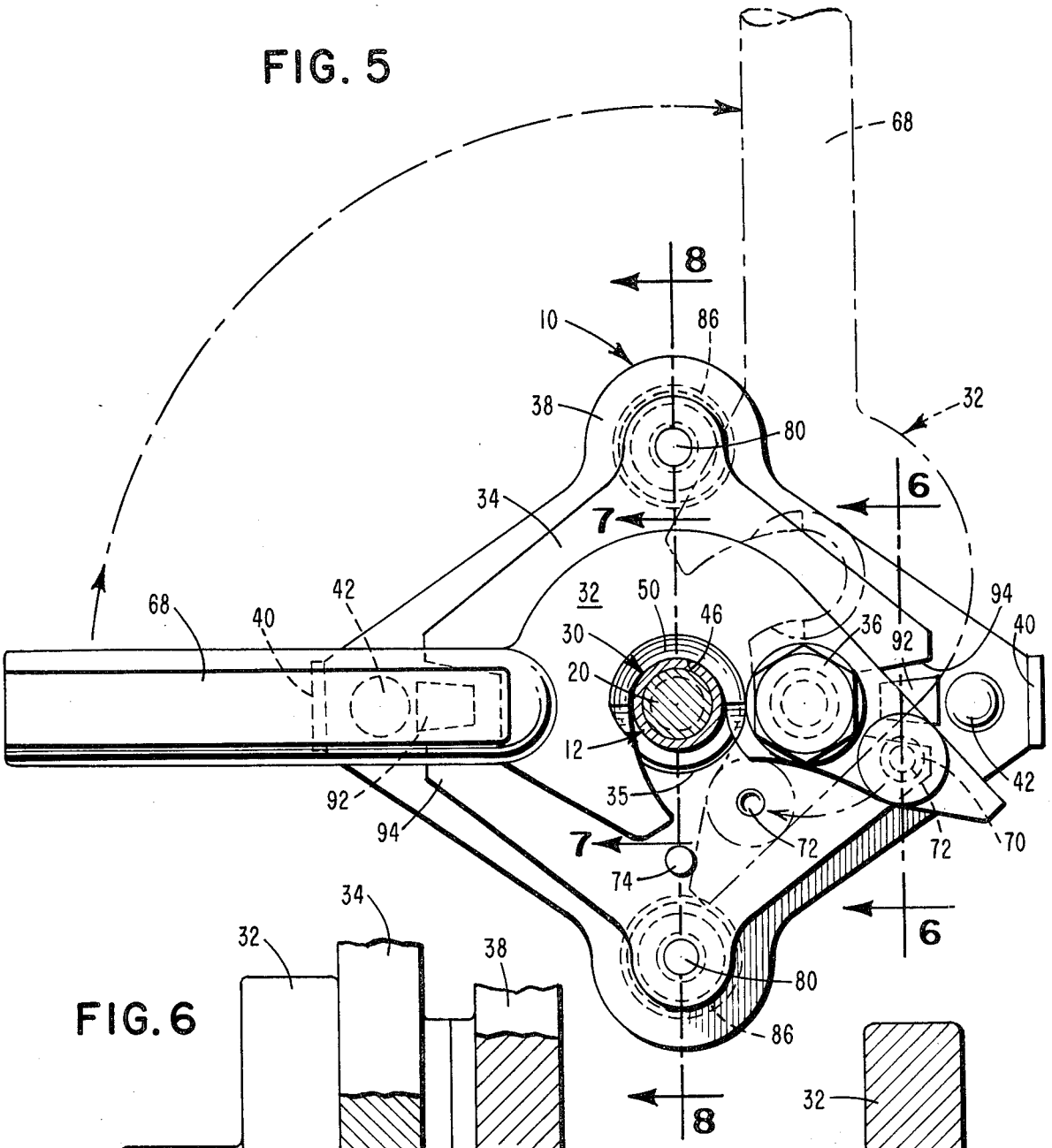
FIG. 6
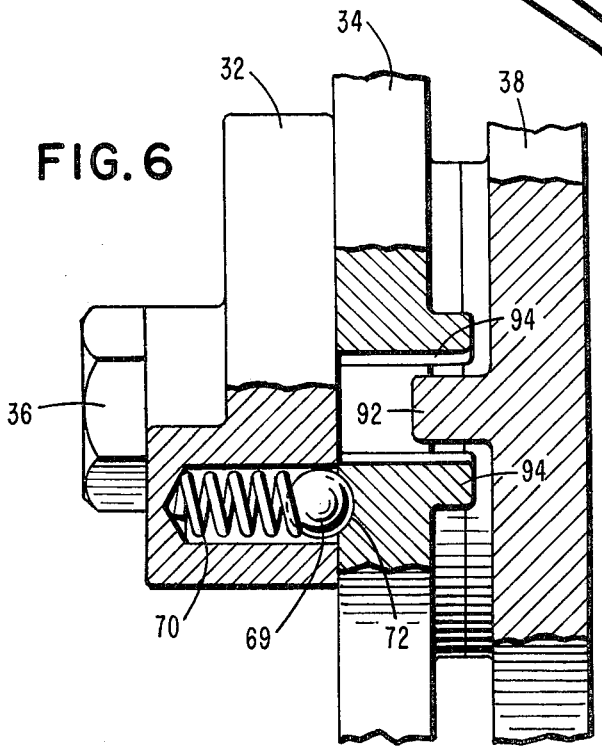
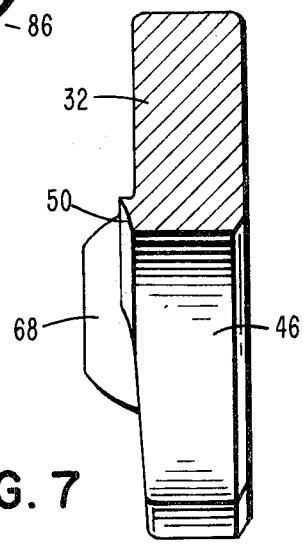
FIG. 7

CONCRETE FORM PANEL TYING APPARATUS

BACKGROUND OF THE INVENTION

This invention relates to the field of concrete construction and more particularly to the field of concrete construction formwork and apparatus for assembling such formwork into functional units. Specifically, this invention relates to apparatus for tying formwork panels together by means of elongated ties and fastening devices attachable to the panels to secure the ties and panels against relative movement.

To construct concrete forms from panels maintained in spaced opposed relationship, numerous prior art devices have been proposed and utilized with varying degrees of success. These devices have generally comprised a rod extending between and through both such panels with varying forms of wedging or locking devices provided to grip the ends of the tie and thus prevent outward movement of the form panels. With devices of this nature the forms are generally provided with spacers to prevent inward movement thereof, and the rod end fastening devices are attached to walers on the form panels. The rod end fastening devices have generally taken the form of loops through which hooks are inserted, nuts threaded onto the end of a threaded tie, or a hot-upset "button" end similar to the head of a nail or bolt. A major disadvantage that all such apparatus has suffered has been the difficulty of removal of the fastening device after the concrete structure has been poured and set. This problem is caused by the expansion of the concrete during setting greatly increasing the outward pressure against the form panels and thus against the tie rod end fastening devices. Accordingly, it has required great force to release these prior art devices in order to remove the form panels. This difficulty in removing the fastening devices has resided principally in the inability of such devices to release the longitudinal stresses on the rods quickly upon the initiation of the releasing action. Another disadvantage suffered by the structures using threaded ties and nuts or ties with enlarged headed ends has been their inability to compensate for misalignment between the tie and the clamping structure on the form panel. Misalignment of these prior art devices, generally manifested by angular displacement of the tie from a line normal to the form panel, has generally resulted in the imposition of the entire longitudinal stress upon one corner or a very small portion of this tie end anchoring structure. This condition not only increases the difficulty of releasing the clamp but also imposes severe bending stresses on the tie, possibly leading to its failure.

In view of the foregoing disadvantages of the prior art devices it is an object of this invention to provide concrete form panel tying apparatus which may quickly and easily be installed to clamp form panels into place and may quickly and easily be removed to release such panels, even when such panels are under great pressure from the concrete structure formed within. It is another object of this invention to provide concrete form panel tying apparatus which compensates for some amount of misalignment between the tie and the form panel and avoids the imposition of excessive point loadings and bending stresses upon the tie.

SUMMARY OF THE INVENTION

This invention, in brief, involves concrete form panel tying apparatus comprising an elongated tie having end portions of a first transverse dimension and having adjacent longitudinally inward portions of a second and smaller transverse dimension with a longitudinally outwardly sloped convex surface extending between each said inward portion and said adjacent end portion, and means attachable to a concrete wall form panel for clamping said tie to restrain relative movement between said tie and the form panel, said clamping means comprising at least one member movable between a clamping position receiving said tie and a nonclamping position away from said tie, said member having a recess therein for receiving said longitudinally inward tie portion, a portion of said member adjacent said recess and distal the form panel sloping toward the recess and toward the form panel to engage said surface of said tie when said clamping member is moved into said clamping position. Various embodiments of both the elongated tie and the clamping means of this invention compensate for misalignment between the tie and the form panels and provide additional features advantages in various applications of the invention.

BRIEF DESCRIPTION OF THE DRAWINGS

The foregoing objects, as well as others, will become apparent through consideration of the following detailed description and the accompanying illustrations in which:

FIG. 5 is an elevational view, partially in section, of the form panel tying apparatus of FIGS. 1-3;

FIG.6 is a vertical section of the tying apparatus taken along line 6-6 of FIG. 5;

FIG. 7 is a vertical section of the clamping member taken along line 7—7 of FIG. 5;

DETAILED DESCRIPTION OF ILLUSTRATIVE EMBODIMENTS

While several illustrative embodiments of this invention will be described herein, the primary description will be based upon the embodiment generally illustrated in FIGS. 1, 2 and 3.

Figure 1:
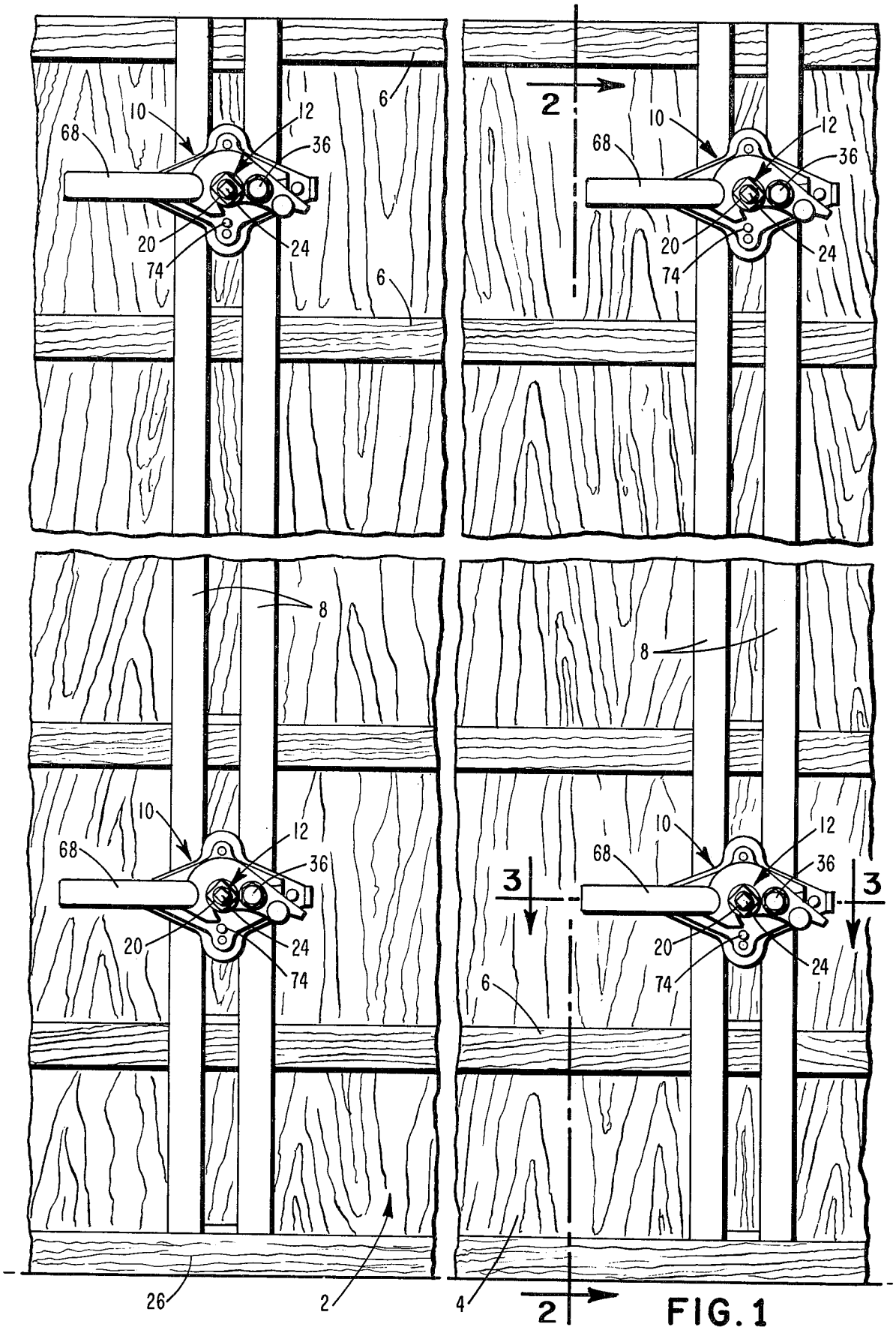
FIG. 1 represents a typical installation of the concrete form panel tying apparatus of this invention.
Figure 2:
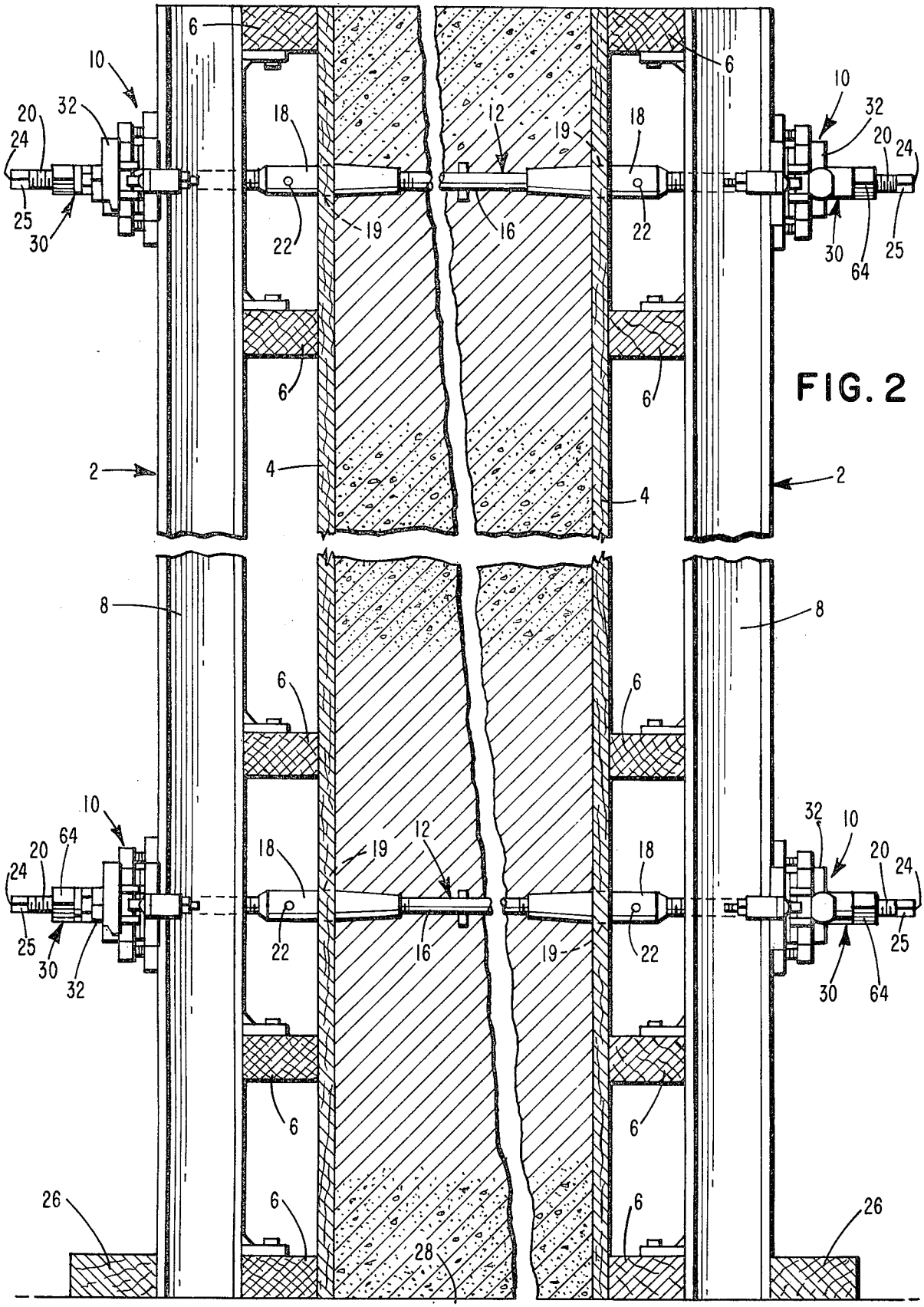
FIG. 2 represents a vertical section through the installation taken along line 2—2 of FIG. 1.

FIGS. 1 and 2 illustrate the application of this tying apparatus to a pair of substantially identical opposed concrete form panels 2. These form panels 2, of any desired height and width, may suitably comprise plywood panels 4 braced with horizontal wooden walers 6 and vertical steel channel walers 8. Releasably attached to the vertical walers 8 are a plurality of tie anchoring clamping units 10 for releasably clamping the form panels 2 to ties 12 extending through the concrete structure 14, which here is illustrated as a vertical wall.

The ties 12 may conveniently comprise either a solid steel member or, as illustrated here, a threadedly connected multi-part steel structure. In this embodiment the tie 12 comprises an inner tie 16 permanently and nonrotatably imbedded in the concrete and having threaded ends, each of these ends threadedly received into an elongated tapering nut 18. The nut 18 in turn is threaded onto outer tie 20 and affixed thereto by pin 22 extending through both the nut 18 and the outer tie 20. The outermost extremity 24 of the outer tie 20 conveniently may be provided with a square head formed by opposed flats 25 to facilitate rotation thereof by a wrench for later removal of the outer tie 20 and tapered nut 18 from the concrete structure. This inner tie, if desired, could be made removable by encasement within a plastic sleeve extending between the form panels 2. The illustrated clamping engagement of the tie 12 by the clamping unit 10 secures the form 2 against any substantial displacement longitudinally of the ties 12. Conveniently, a "kick strip" 26 may be secured to the subjacent supporting structure 28 to provide a stop to prevent any outward movement of the base of the form panels 2.

Figures 3, 4:
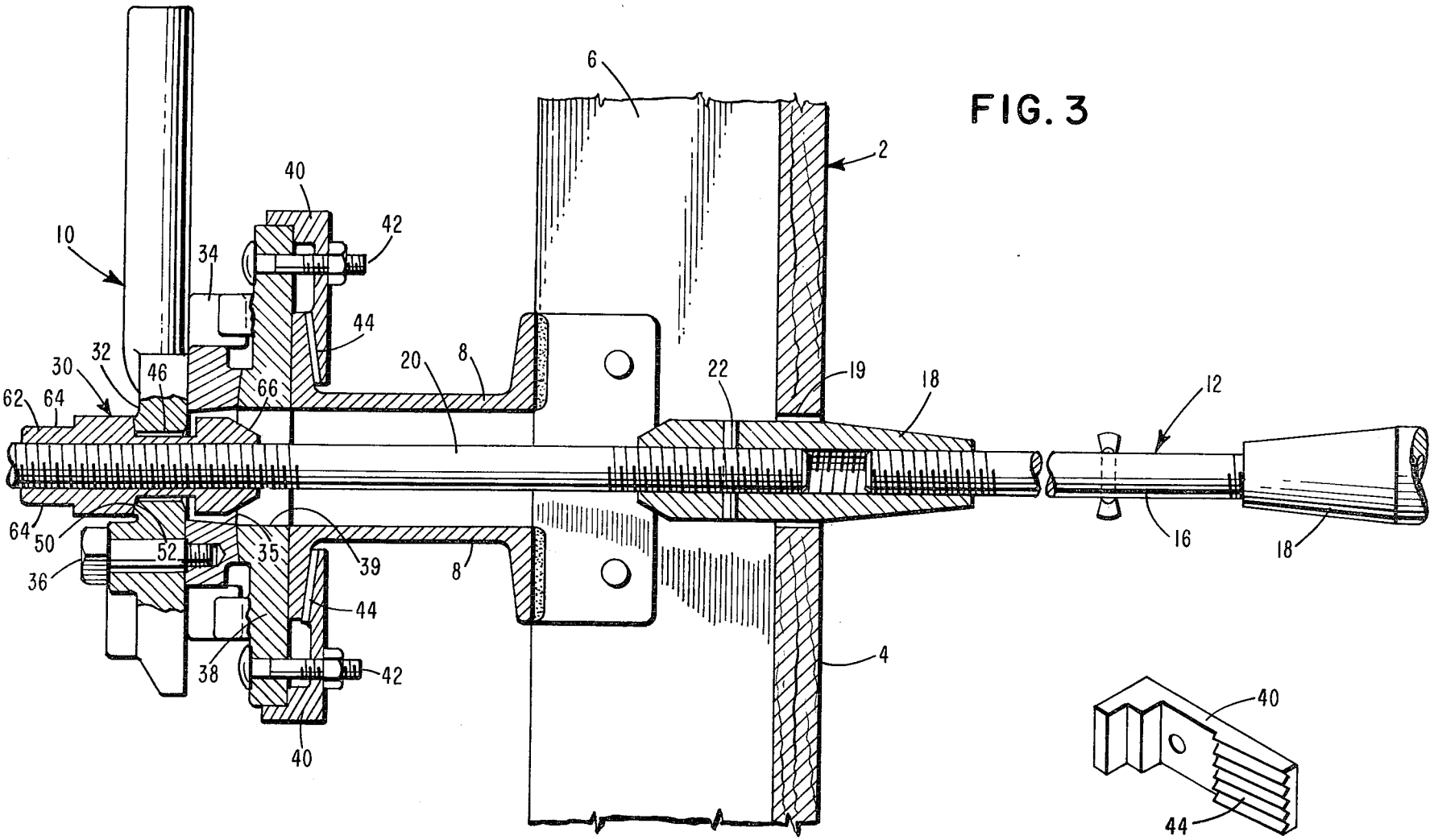
FIG. 3 represents a horizontal section taken through the concrete form panel tying apparatus of FIG. 1, taken along line 3—3 of FIG. 1.
FIG. 4 illustrates one of the devices used for attaching the formwork typing apparatus of FIG. 3 to a waler.
Figure 11:
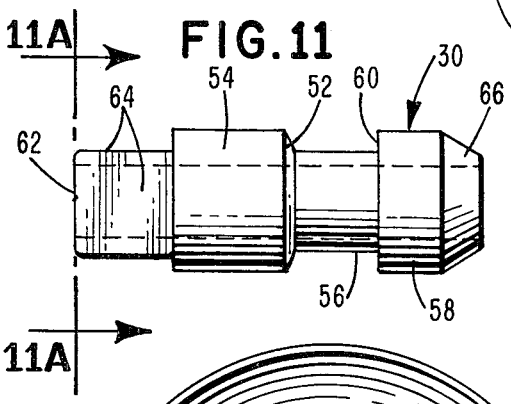
FIG. 11 is a side elevation of a device for anchoring a threaded tie to a form panel.
Figure 11A:
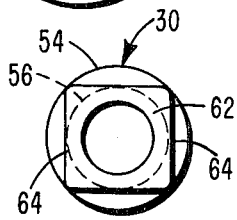
FIG. 11A is an end elevational view of the anchoring device taken along line 11A—11A of FIG. 11.

The detailed structure of the tying apparatus of FIGS. 1 and 2 is more clearly illustrated in the horizontal section of FIG. 3. This figure illustrates the manner in which the elongated, tapered connecting nut 18 joins the inner tie 16 to the outer tie 20, to which the nut 18 is pinned. The nut 18 extends through a closely fitting aperture 19 in panel 4, with the longitudinally tapering portion projecting inwardly of the panel. Such a longitudinal taper facilitates removal of the nut 18 after the concrete structure has set. The longitudinally outer portion of outer tie 20 extends between vertical walers 8 and through apertures in the clamping apparatus 10 and threadedly receives the internally threaded anchoring nut 30, illustrated more clearly in FIGS. 11 and 11*a*. By virtue of the engagement of this anchor nut 30 with the clamping structure 10, the position of the nut 30 longitudinally of the outer tie 20 effectively determines the positioning of opposing form panels 2.

FIG. 3 also illustrates the tie anchoring clamping apparatus 10, which includes a clamping member 32 engaging the anchor nut 30, a mounting member 34 to which the clamping member 32 is pivotally attached by means of shoulder bolt 36, and bearing member 38, which abuts the flanges of walers 8 and bears the inward forces exerted by the remainder of the clamping structure and is attached to mounting member 34. Each of such members 32, 34 and 36 suitably may be fabricated of ductile steel. As indicated, the anchor nut 30 is received through apertures 35 and 39 of members 34 and 38, respectively, with aperture 35 only slightly larger in diameter than the tie portion projecting therethrough and aperture 39 substantially larger than such tie portion, to facilitate clamping and alignment of the tie, as described below. Conveniently, bearing member 38 may releasably be attached to the waler flanges by gripping members 40, illustrated in FIG. 4, which are received onto studs 42 projecting inwardly from bearing member 38. These gripping members 40 desirably are provided with teeth 44 which extend horizontally in the installed position, thus to restrain the tie anchoring clamping structure 10 against sliding down the waler when attached thereto.

In the plan view of FIG. 5 the apparatus of this invention is shown with the clamping member 32 both in its clamping position (solid line representation) engaging the tie 12, shown in section, and with the clamping means 32 pivotally moved to its nonclamping position away from the tie (phantom line representation). When this clamping member 32 is in its clamping position, it may be seen that recess 46, in the form of an arcuate slot in clamping member 32, is matingly received about a portion of the tie 12. Since the tie 12 of this preferred embodiment is round and the recess 46 is configured to correspond with the cross-sectional configuration of the tie, the inner end of the recess 46 is semicircular and of a diameter only slightly greater than that of the portion of the tie 12 received therein.

When the clamping member 32 is in its clamping position engaging the tie 12, it may be seen from FIG. 3 that there is engagement between clamping member surface 50 and tie anchor nut shoulder 52 to restrain any motion of the form 2 longitudinally outwardly of the tie 12. In the plan view of FIG. 5 it may be seen that the tie engaging surface 50 of the clamping member 32 comprises the portion of the member 32 adjacent the semicircular end portion of the slot 46. As seen most clearly in FIG. 3, this clamping member surface 50 and the mating surface 52 of the tie slope longitudinally inwardly of the tie 12 toward the form panel 2 and slope inwardly toward the recess 46. For reasons to be described more fully below, the sloping surface 52 of the tie preferably is convexly sloped, at least at the radially outer portions thereof. Similarly, the mating sloping surface 50 of the clamping member 32 preferably is concavely curved. These mating surface configurations provide both for angular misalignment and for easy removal of the tie and clamping structure. To facilitate initial clamping engagement between the tie 12 and the clamping member 32, the clamping member portion adjacent the slot 46 and outward of the semicircular end portion thereof is inclined longitudinally inwardly of the tie 12 to provide a ramp for exerting longitudinally outward force on the tie as the clamping member 32 is moved to its clamping position. Additionally, the slot 46 is arcuate with the center of curvature corresponding to the pivot 36 of the clamping member 32. Thus, when clamping member 32 is pulled from its open position, with clamp member handle 68 in a generally vertical orientation as indicated in phantom in FIG. 5, to the clamping position with the handle 68 generally horizontal, the arcuate slot 46 may smoothly receive the tie 12 as the ramp portion exerts longitudinally outward force upon the tie.

To maintain the clamping member 32 in either its fully open non-clamping position or its full clamping position, a spring loaded ball 69 is provided within a bore 70 in clamp member 32 to engage, selectively and alternatively, either of two detents 72 in mounting member 34, as indicated in the section of FIG. 6. Thus, unintended movement of the clamping member from one position to the other is avoided. Additionally, a pin 74 is provided in mounting member 34 to engage a portion of clamping member 32 and thus prevent rotation of the clamping member past its full open position.

Figure 8:
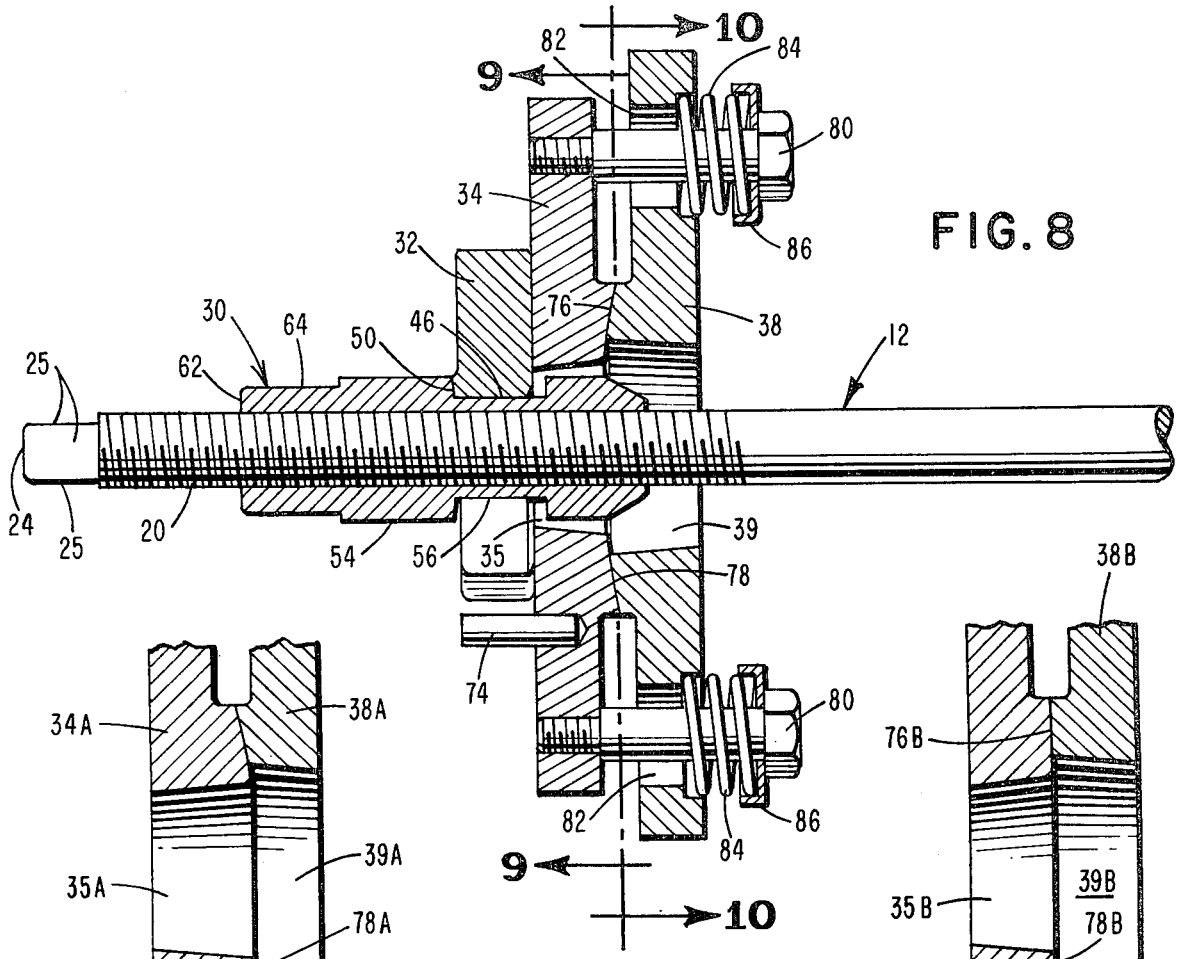
FIG. 8 is a vertical section of the tying apparatus taken along line 8—8 of FIG. 5.
Figure 8A:
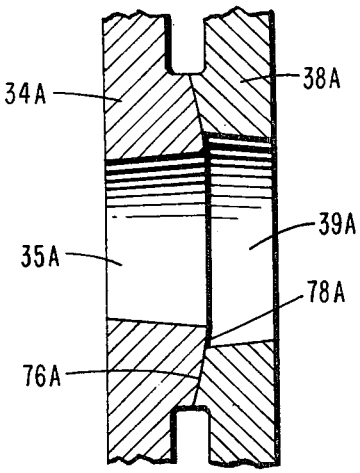
FIG. 8A is a fragmentary sectional view of a variation of the mounting member and bearing member of the apparatus of FIG. 8.
Figure 8B:
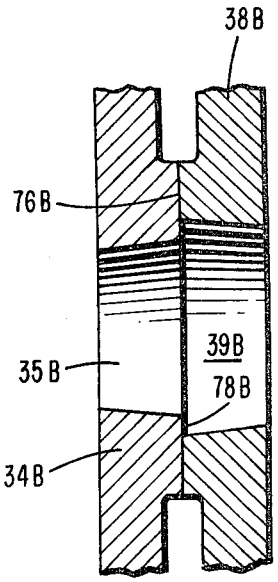
FIG. 8B is a fragmentary sectional view of a second variation of the mounting member and bearing member of the apparatus of FIG. 8.
Figure 9:
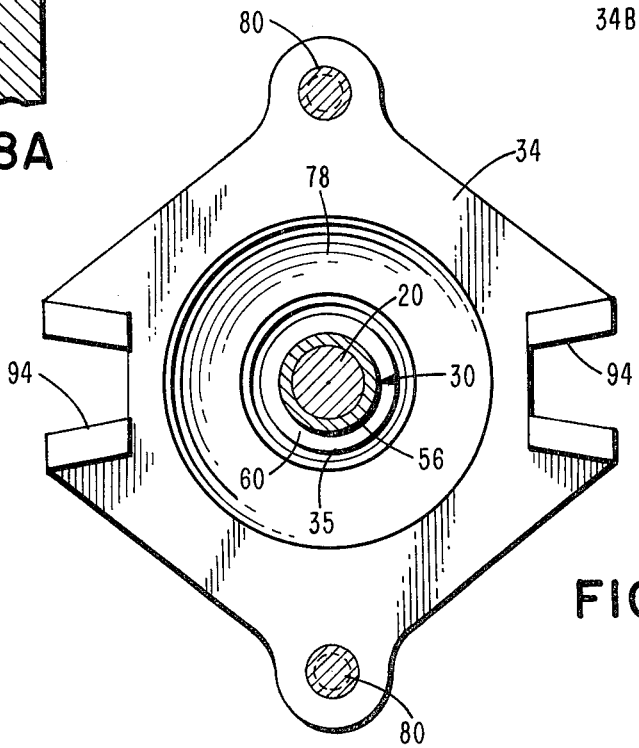
FIG. 9 is an elevational view of the inwardly facing portion of the mounting member of FIG. 8, taken along line 9—9 of FIG. 8.
Figure 10:
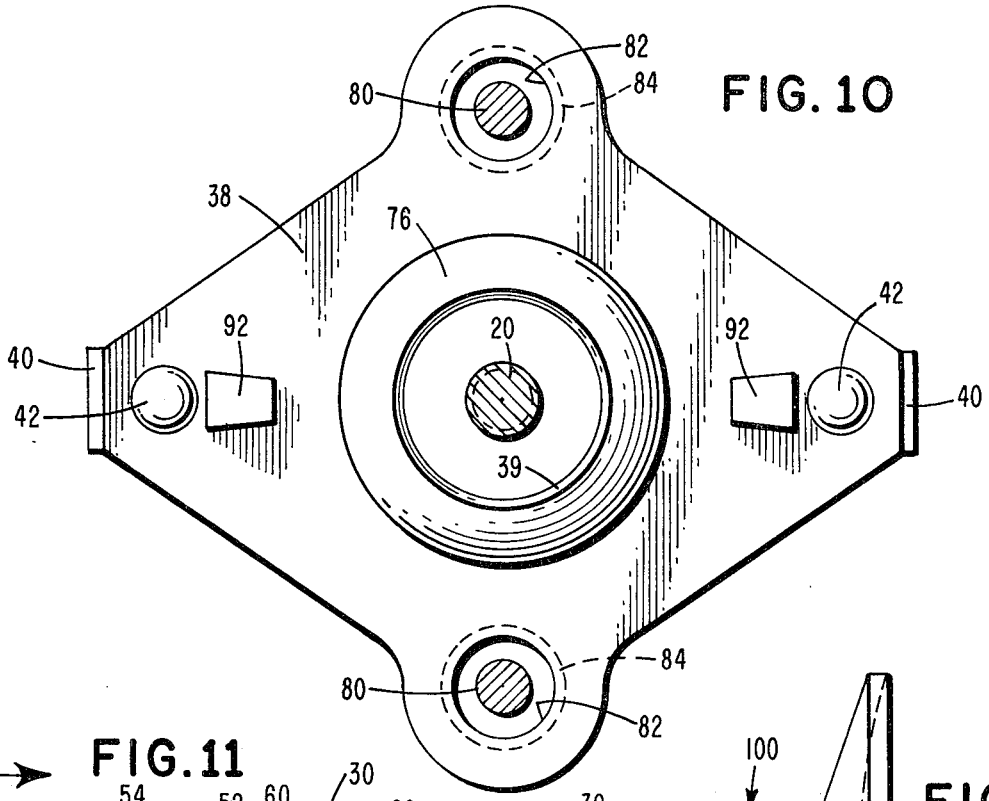
FIG. 10 is an elevational view of the outwardly facing portion of the bearing member of FIG. 8, taken as indicated by the line 10—10 of FIG. 8.

Several additional features of this invention are illustrated in the vertical section of FIG. 8, taken through the apparatus of FIG. 5. As noted above, it is desirable to accommodate some degree of misalignment between the tie 12 and the tie anchoring clamping structure 10. Such accommodation is made in this embodiment by the structural relationship of the bearing member 38 to the mounting member 34. As may be seen from the illustrations the aperture 39 in bearing member 38 is substantially larger than the portion of the tie 12 and nut 30 extending therethrough. This oversize aperture 39 and its conically enlarged configuration permit movement of the tie 12 and anchor nut 30 within the aperture. In this embodiment of the invention the outwardly facing portion of the bearing member 38 also includes a convexly curved spherical surface 76 surrounding the aperture 39. This surface 76 mates with a corresponding concavely curved spherical surface 78 on the inwardly facing portion of the mounting member 34. Such mating spherical surfaces effectively form a portion of a ball and socket joint, with the mounting member 34 permitted to slide transversely and rotate slightly with respect to bearing member 38. Thus, misalignment between corresponding clamping members on opposing form panels 2 may be manifested by angular displacement of the tie from a line normal to the form panels. By virtue of the ball and socket joint formed by the clamping structure the full stress exerted longitudinally of the tie may still be taken uniformly upon the spherical surfaces, thus avoiding the imposition of excessive bending stresses on the tie 12. The same effects and benefits obviously could be obtained from the corresponding structure of FIG. 8A in which the convex and concave portions are reversed. Additionally, compensation for some degree of misalignment could be obtained from the flat mating surfaces of the corresponding structure of FIG. 8B, wherein such compensation might take the form of sliding translation of the mounting member 34B with respect to the bearing member 38B along the mating surfaces 76B and 78B. Further, it may be noted that, while the disclosed spherically curved surfaces accommodate misalignment in any direction, provision for such misalignment in only one axis could be obtained by the use of corresponding surfaces which are cylindrically so curved. The movement between members 34 and 38 necessary to allow for such misalignment is facilitated by the adjustable attachment of mounting member 34 to bearing member 38, as shown in FIG. 8. This adjustable attachment may be achieved through the use of shoulder bolts 80 threaded into member 34 and projecting through oversize holes 82 in bearing member 38. Between the head of each shoulder bolt 80 and the bearing member 38 is a compression spring 84 and retainer 86. This mounting arrangement thus tends to center members 34 and 38 and align their respective central apertures 35 and 39, through which the tie 12 passes, but, with the oversize aperture 39, permits both the above-described angular and transverse translational movement between the members, thus to accommodate the aforementioned misalignment. Excessive rotational or translational movement of the member 34 with respect to bearing member 38 is restrained by engagement of the outwardly projecting bosses 92 of the bearing member 38 with the edges of the slots 94 formed in mounting member 34, as most clearly illustrated in FIGS. 6, 9 and 10.

While a substantial degree of misalignment between the tie and the clamping structure is accommodated by the mating surfaces of the mounting member 34 and the bearing member 38, other significant benefits may be obtained by the manner of engagement between the clamping member 32 and the tie 12. This manner of engagement and the structure relating thereto are shown more clearly by reference to the vertical sectional views of FIGS. 7 and 8 and the enlarged fragmentary sectional views of FIGS. 17, 18 and 19, the three latter figures corresponding generally to the sectional view of FIG. 8. As is illustrated most clearly in FIG. 18, the engagement between clamping members 32 and tie 12 occurs by engagement of surface 50 of the clamping member with surface 52 of the tie. In this case, the tie comprises an end portion 54 having a first diameter or transverse dimension. Adjacent this end portion 54 is a longitudinally inward portion 56 having a second and smaller diameter or transverse dimension. Extending between outer portion 54 and longitudinally inward portion 56 is the surface 52 with at least the radially outward portions thereof having a convex curvature and thus sloping longitudinally outwardly of the tie. Preferably, as in the illustration, the entire surface 52 is convexly curved and sloping longitudinally outwardly. Axially adjacent the second tie portion 56, and opposite surface 52, is the tie third portion 58 having a diameter or transverse dimension greater than that of portion 56 and desirably equal to that of outer portion 54. Conveniently, a shoulder surface 60 extends radially outwardly from second portion 56 to the radially outer extremity of third portion 58 to engage clamping member 32 and prevent inward movement of the form panel.

The concave curvature of the surface 50, sloping inwardly toward the form panel and configured to mate with tie surface 52 provides substantial additional benefits to the use of this structure. As is most readily apparent in FIGS. 5 and 7, this concave sloped surface 50 comprises the portion of the clamping member 32 immediately adjacent the semicircular end portion of the slot 46. Thus, supportive engagement between the clamping member 32 and the tie 12 occurs around that semicircular surface 50. By virtue of the curved, and preferably spherical, mating surfaces 50 and 52, the engagement of these members forms a portion of a ball and socket joint. Accordingly, slight angular misalignment between the tie 12 and the axis of the clamping structure may be compensated by both this ball and socket arrangement, as shown in the exaggerated representation of FIG. 17, and by the similar socket between mounting member 34 and bearing member 38. Thus, even in a condition of such misalignment as might be caused by a 1¼ inch displacement of opposing form panels spaced only 12 inches apart, longitudinal stresses exerted by the formwork against the tie remain relatively evenly distributed over the full semicircular engagement and are not significantly concentrated on a small portion of the tie. This structure substantially avoids the imposition of bending moments such as might be created if the mating surfaces of the tie and the clamping member were flat.

Figure 17:
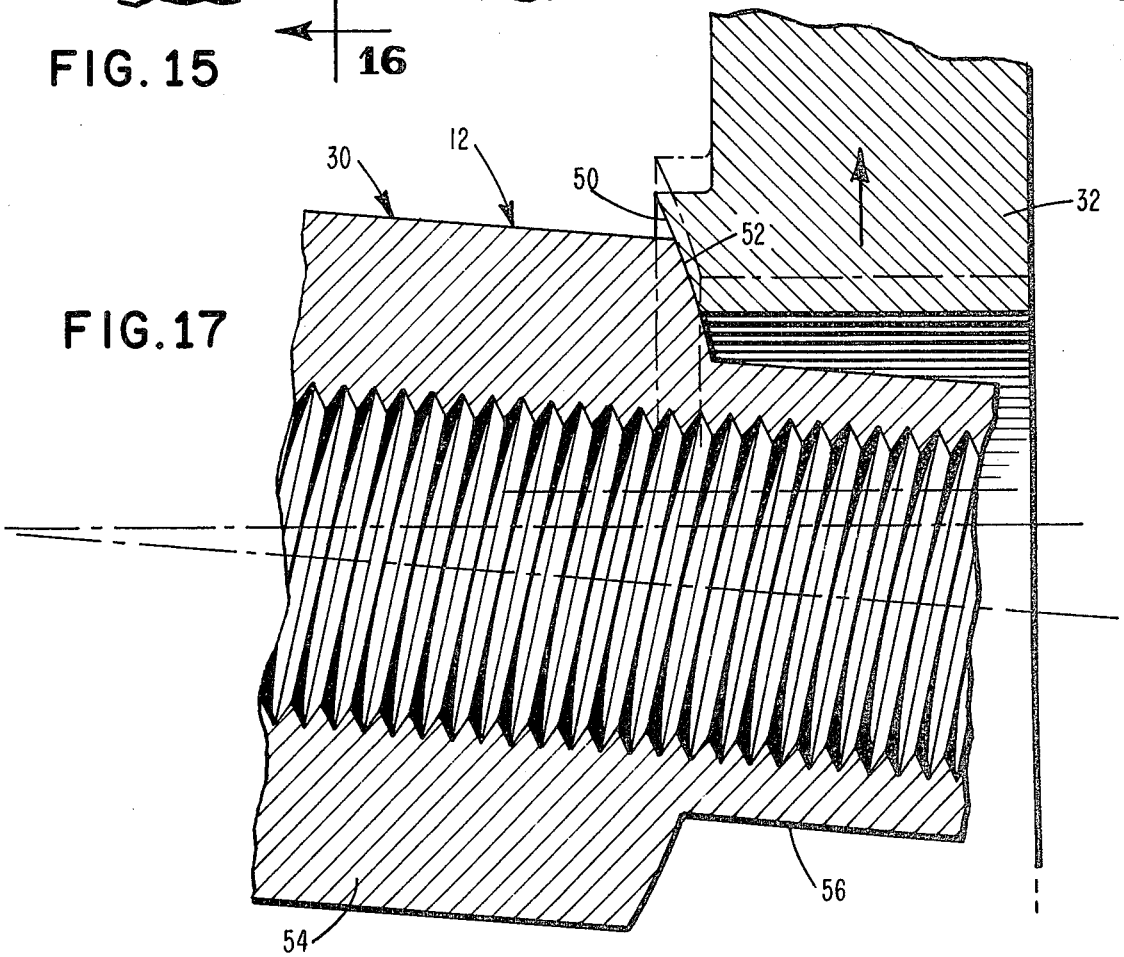
FIG. 17 is a fragmentary view in vertical section of the tie and clamping member of FIG. 8, with such members angularly misaligned to illustrate another feature of this invention.
Figure 18:
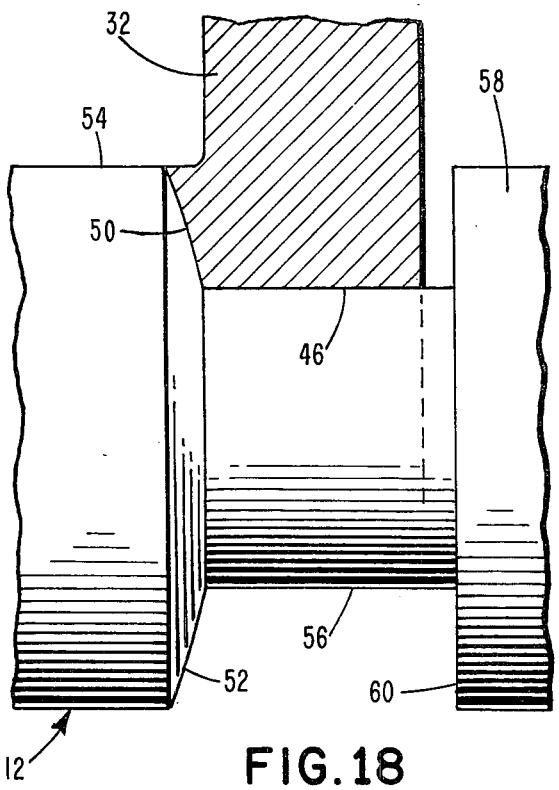
FIG. 18 is a partial vertical section similar to FIG. 8, illustrating the manner of engagement between the tie and clamping member of this invention, with a portion of the clamping member shown in section.
Figure 19:
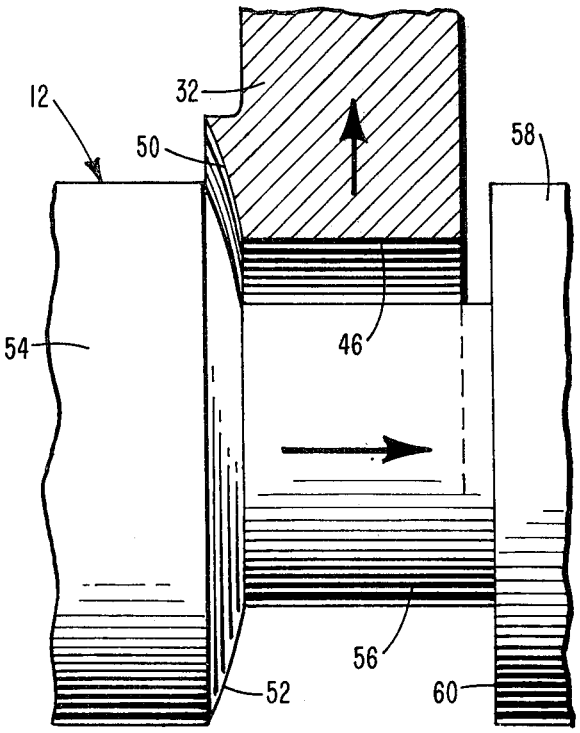
FIG. 19 is a vertical section similar to FIG. 18, illustrating the manner of releasing engagement between the tie and clamping member of this invention at the initiation of the movement of the clamping member, shown in section, toward its nonclamping position out of engagement with the tie.
Figure 25:
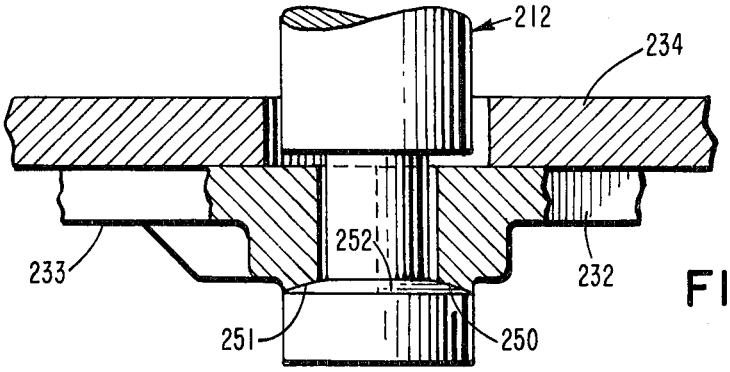
FIG. 25 is a horizontal sectional view of the apparatus of FIG. 24 taken along line 25—25 of FIG. 24.
Figure 26:
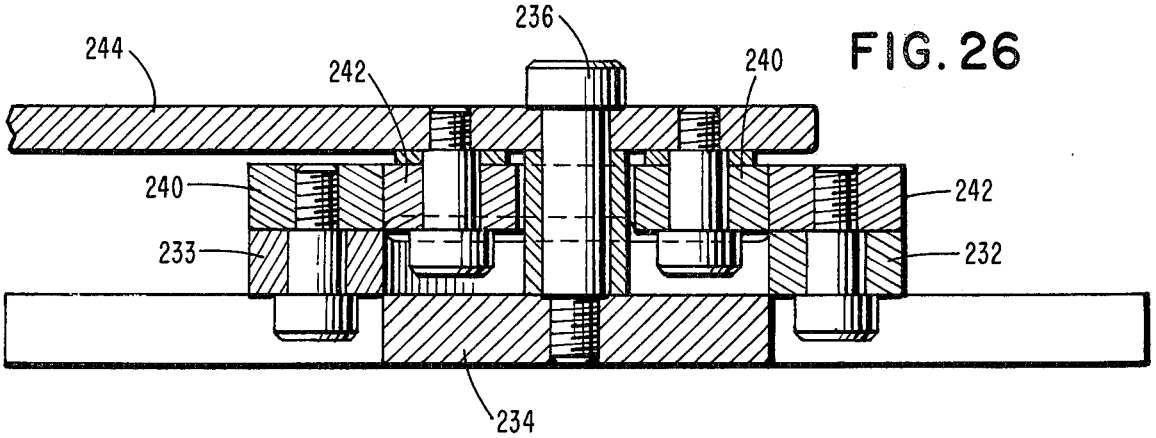
FIG. 26 is a horizontal sectional view of the apparatus of FIG. 24 taken along line 26—26 of FIG. 24.

A second benefit from this structure, stemming largely from the sloping curved configuration of the mating surfaces 50 and 52, is illustrated in FIG. 19 and by the broken line representation in FIG. 17. These figures illustrate the relative action of the tie 12 and the clamping member 32 upon the initiation of movement of the member 32 from its clamping position to its nonclamping position. By virtue of the sloped curved surface even slight movement of the member 32 away from its clamping position, as indicated by the arrows in FIGS. 17 and 19, permits the tie 12 to move relatively axially inwardly of the clamping member 32, thus relieving the axial or longitudinal stresses developed in the tie by the expansion of the concrete structure during curing. Accordingly, the longitudinal stresses are relieved substantially immediately upon the initiation of such movement, so that the effort required for complete removal of the clamping member 32 to its nonclamping position is reduced substantially from that which would obtain through the mating of tie and clamping member surfaces substantially normal to the axis of the tie.

While a continuous solid tie is equally suitable for use with this invention, the preferred embodiment described above incorporates a threaded tie with the above described clamping member engaging surfaces formed on a nut threadedly inserted onto the end of such tie, as described above. Such a nut, suitable for use on any threaded tie, is more clearly illustrated in FIGS. 11 and 11*a*. In addition to the structure illustrated in the enlarged representations of FIGS. 17, 18 and 19, it may be seen that the outermost sections of the outer end portion 54, adjacent the outer surface 62 have two pairs of radially opposed flats machined therein parallel to the nut axis. These flats facilitate gripping by a wrench for rotation of the nut. Additionally, adjacent the third portion 58 of the nut is a second conically tapering end portion 66 to facilitate insertion of the nut 30 into the relative close-fitting aperture 35 of the mounting member 34 during assembly of the tie and clamping structure. Another substantial advantage of this threaded tie and anchoring nut structure is the readily available means for adjusting the effective length of the tie by screwing the anchor nut 30 longitudinally inwardly or outwardly of the tie.

Thus, it may be seen that numerous substantial benefits are offered by the use of the above described structure for tying together concrete formwork panels. Compensation for misalignment between the tie and the panel is provided by the engagement of the respective curved surfaces. Standard threaded tie components may be used to permit the construction of walls or other structures of widely varying thicknesses, and rapid release of the longitudinal stresses on the tie rod is provided by the clamping structure. Additionally, it should be noted that such longitudinal stress may be relieved by this structure in any one of three ways: a release of the clamping means by movement of the handle 68 to the nonclamping position, rotation of the anchor nut 30 to threadedly relieve such stress even while such nut remains clamped by the clamping member 32, or rotation of the outer tie 20 itself, also to threadedly relieve such stress. This last means of releasing pressure is facilitated by the provision of flats 25 on the outer end of outer tie 20, as indicated in FIG. 8.

Figure 12:
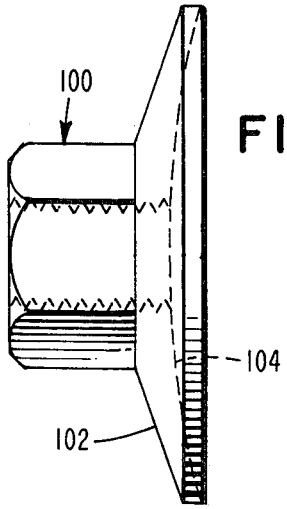
FIG. 12 is a side elevation of another embodiment of a device for anchoring a threaded tie to a form panel.
Figure 13:
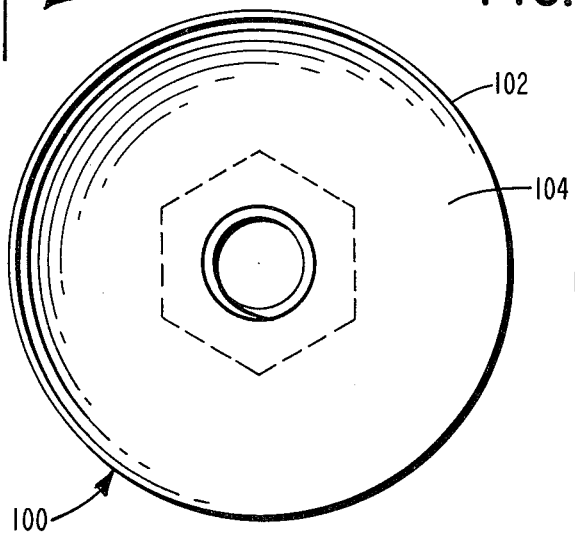
FIG. 13 is an elevational view of the inwardly facing portion of the anchoring device of FIG. 12.
Figure 14:
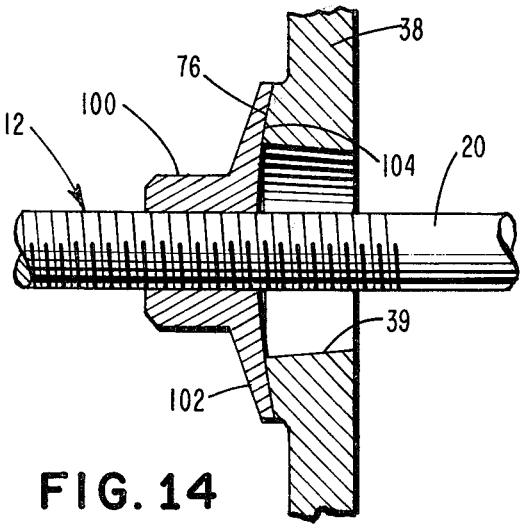
FIG. 14 is a vertical sectional view of an installation of the threaded tie anchoring device of FIG. 12.

While numerous other variations of this invention readily present themselves, a few of the more significant are illustrated in the remaining figures. FIGS. 12 and 13 illustrate a threaded anchor 100 having a large circular flange 102 with an outwardly facing convexly spherically curved surface 104 to matingly engage and cooperate with surface 76 of bearing member 38, as illustrated in FIG. 14. This structure, while providing only for release of longitudinal stress on the tie 12 by rotation of either of such tie outer portion 20 or the anchor 100, does provide compensation for substantial misalignment between the time and the bearing member attached to the form panel. Similarly, a washer having one suitably curved surface and one flat surface could be used in conjuction with an ordinary flat nut to accommodate such angular misalignment, engaging either the bearing member 38 as here, or the clamping member 32 as described above. Such a nut and washer combination would serve as a fully equivalent substitute for the special nuts described.

Figure 15:
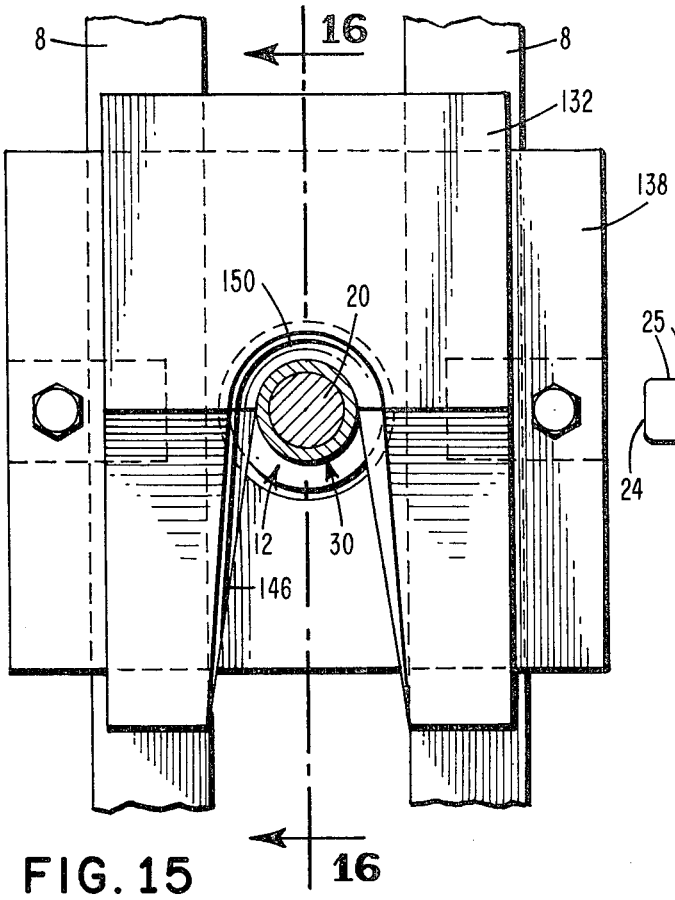
FIG. 15 is a front elevational view, partially in section, of another embodiment of the form panel tying apparatus of this invention, incorporating a sliding, wedge-like plate.
Figure 16:
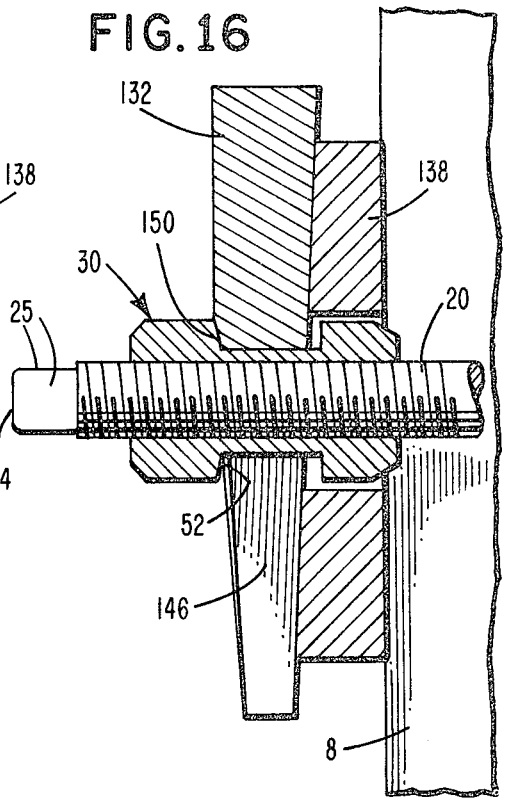
FIG. 16 is a vertical sectional view taken along line 16—16 of FIG. 15.

In FIGS. 15 and 16 there is illustrated another embodiment of the quickly releasable clamping structure. In this embodiment the same type of anchor nut 30 and threaded outer tie 20 may be used. However, the clamping, mounting and bearing members are replaced by slidable, wedge-shaped clamping member 132 cooperating with oppositely inclined wedge-shaped bearing member 138. This clamping member 132 includes a slot 146 having a semicircular inner end portion with a convexly inwardly sloped tie engaging portion 150 adjacent this semicircular inward slot portion, for substantially the same purposes as discussed with regard to the previous embodiment. As with the previous embodiment the portion of clamping member 132 generally adjacent the slot 146 and extending outwardly of the semicircular inward portion thereof is inclined to provide a ramp for the engagement of the tie 12. By the use of the corresponding inclined surface of the bearing member 138, the tie engaging surface 150 may mate squarely with the surface 52 of the tie. Also, as with the previous embodiment, the longitudinally outward stresses imposed upon the tie by this clamping structure would be relieved immediately upon initiation of the movement of the clamping member 132 away from engagement with the tie toward its nonclamping position in the manner described above.

Yet another embodiment of the clamping structure of this invention is illustrated in FIGS. 23, 24, 25 and 26. This structure, while slightly more complex than the preceding, may be especially desirable where extreme longitudinal stresses on the tie 212 are anticipated. The principal benefit of this embodiment is that the two mating clamping members 232 and 233 completely surround the head of the tie 212 when in the clamping position illustrated in FIG. 23 and thus provide a large load bearing surface. These clamping members 232 and 233, possessing the above described concavely sloped tie engaging surfaces 250 and 251, respectively, are jointly pivotally connected to mounting member 234 by means of pivotal connection 236. These clamping members 232 and 233 also are pivotally connected to an actuating handle 244 by means of linkage members 240 and 242, respectively. Such interconnection provides for joint pivotal movement of the two clamp members when the actuating handle 244 is pivoted about pivot member 246 between the clamping configuration illustrated in FIG. 23 and the nonclamping configuration illustrated in FIG. 24. It may be noted that this embodiment is illustrated as used with a solid tie 212 in place of the threaded tie and anchoring nut of the previous embodiment. This solid tie 212 is the full equivalent of previously described multi-part tie 12 and has a convexly sloped surface 252 for cooperation with the clamping member surfaces 250 and 251 in the above described manner. Such a solid tie 212 may also be removable from a completed concrete structure if it is encased within a plastic sleeve extending between the form panels. It may also be noted that the overcenter toggle structure of the actuating linkage serves itself to releasably hold the clamping members in either the clamping position or the non-clamping position as desired, thus obviating the necessity for a detent as in the previous embodiment.

While most of the preceding embodiments have been illustrated in conjunction with a multi-part threaded tie wherein an inner threaded tie is left imbedded in the concrete structure at completion of the job, it must be noted that other forms of tie are equally suitable for practicing this invention. More particularly, solid ties preferably having a continuous taper, such as those illustrated in FIGS. 20, 21 and 22, may also be used to practice this invention. After the concrete structure has set, the continuous taper of these ties permits them to be driven out of engagement with the structure.

Figure 20:
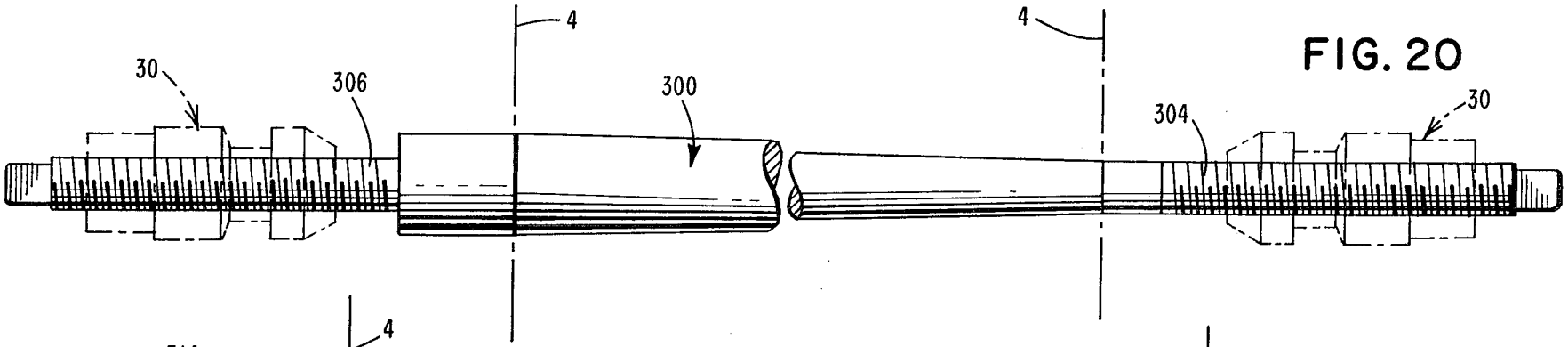
FIGS. 20, 21 and 22 are side elevations of three embodiments of tapered form panel ties to be used with the apparatus of this invention.

A first embodiment of this tapered tie structure is generally indicated by the reference numeral 300 in FIG. 20. This elongated tie 300 comprises a central section tapering longitudinally from a first diameter or transverse dimension to a second smaller transverse dimension or diameter. Outwardly of this center section are two axially aligned outer sections 304 and 306, both of the same diameter, not larger than the smaller diameter of the tapered section, and both having threads of equal size. The threads of the outer sections 304 and 306 are suitable for threadedly receiving threaded anchors thereupon, preferably of the nature of either the anchor nuts 30 or the anchor nuts 100 of the previous embodiments.

Figure 21:
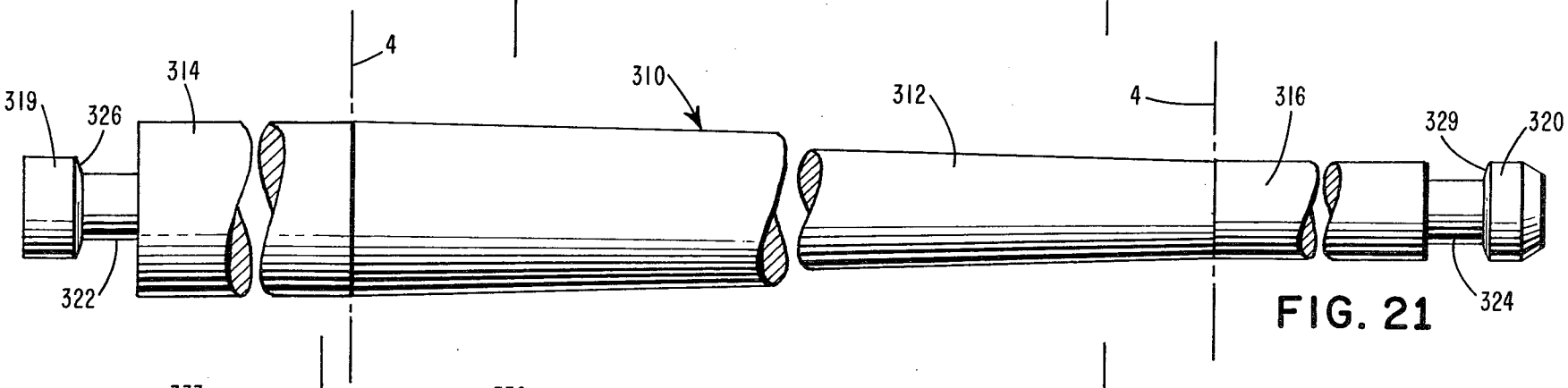

The tapered tie 310 of FIG. 21 is a solid, unitary member having the desired end portions integral therewith. As in the above embodiment this tie 310 comprises a longitudinally tapering central section 312 with opposing outer sections 314 and 316 extending outwardly therefrom. In this embodiment the respective outer end portions 318 and 320 of end sections 314 and 316 are of substantially the same diameter, equal to the outer transverse dimension of the anchor nut 30 of the earlier embodiments. Similarly, corresponding adjacent longitudinally inward portions 322 and 324 are of a smaller diameter, also as described above, and are joined to the respective outer end portions by convex sloped surfaces 326 and 328, respectively. With this embodiment identical clamping members could be used with the clamping structur4e at both ends, and the diameter of the portion 316 would permit the use of all of the previously described clamping structure for engaging that end of the tie. However, the enlarged diameter of the opposite end section 314 would necessitate use of bearing members 38 and mounting members 34 having suitably enlarged apertures 39 and 35, respectively, in order to obtain the necessary clamping and the desired benefits. It may be noted with each of the solid tapered ties disclosed that it is highly desirable to configure the smaller diameter end portion no larger in diameter than the smallest diameter of the tapering central section in order to facilitate later removal of the tie from the concrete structure.

Figure 22:
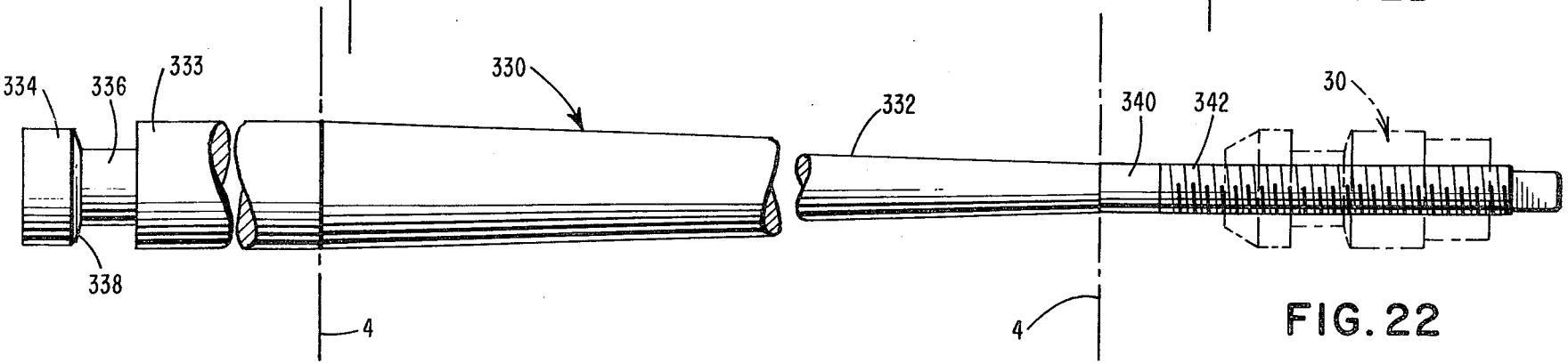
Figure 23:
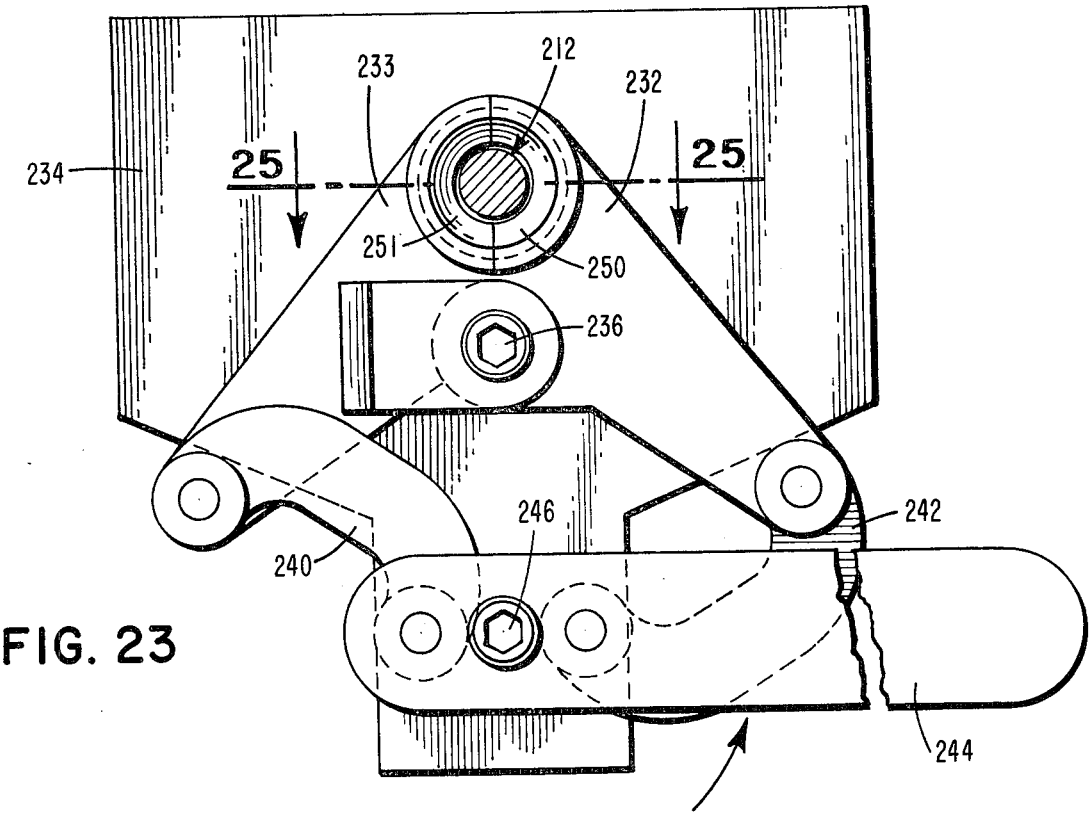
FIG. 23 is a front elevational view of the outwardly facing portions of another embodiment of the tying apparatus of this invention, illustrated in its clamping position with clamping members engaging the tie.
Figure 24:
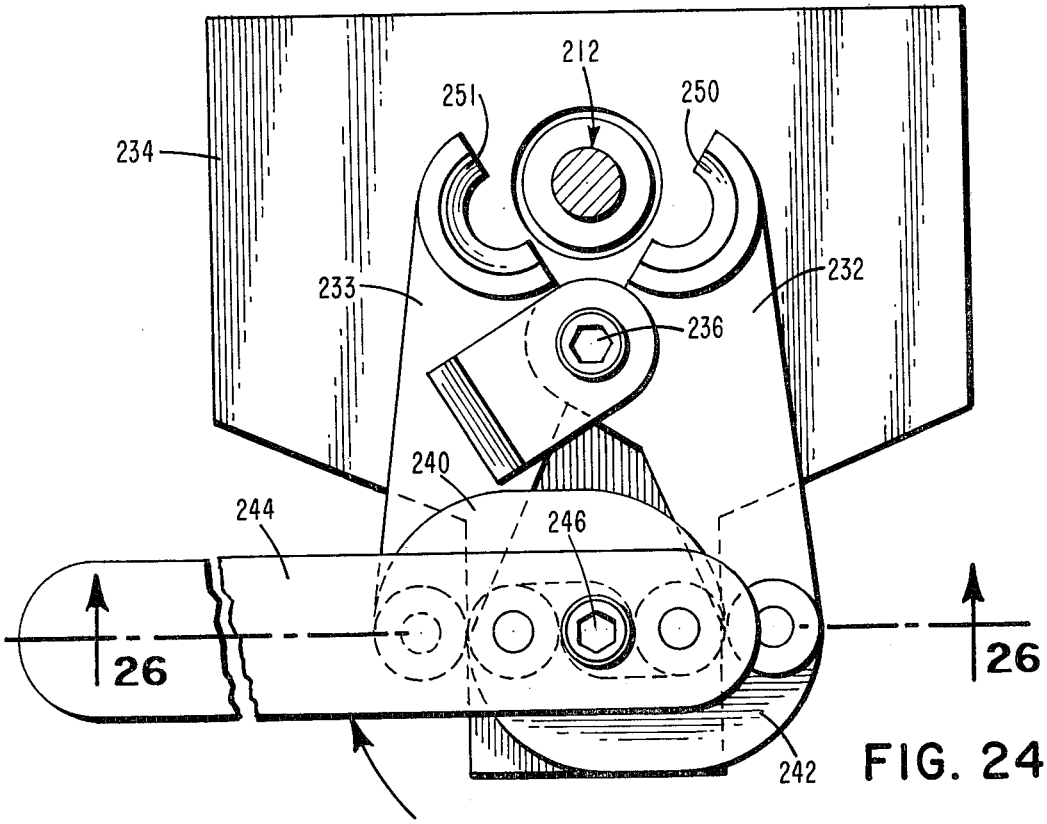
FIG. 24 is a plan view of the apparatus of FIG. 23 with the clamping members moved to their nonclamping positions away from engagement with the tie.

A third embodiment 330 of the tapered tie, shown in FIG. 22, likewise incorporates a longitudinally tapering central section with end sections extending outwardly therefrom. The larger end section 333 of this tie is configured generally similarly to the smaller end portion of the embodiment of FIG. 21. Specifically, the outer end portion 334 is of a first diameter with a longitudinally adjacent inward portion 336 of a second and smaller diameter and joined to said outer end portion by a sloping convex surface. The opposite outer section of this tie is of a diameter generally equal that of the smallest diameter of the tapering portion and is provided with threads suitable for threadedly receiving thereupon an anchoring member such as the nut 30 described with previous embodiments. With this embodiment the fixed outer end portion 333 may desirably be the same diameter as the largest diameter of the anchor nut 30, so that identical clamping apparatus may be used to clamp each end of the tie.

In each of the tie embodiments described and illustrated there is provided not only an outward, convexly curved shoulder for engaging a clamp member to restrain any outward movement of the clamp and the form panels, but also there is provided an inner shoulder to restrain opposing clamp members and form panels against any movement toward one another. Obviously, the principal benefits of this invention could be obtained with tie structure omitting such inner shoulder and using separate spacers to restrain opposing form panels against movement inwardly toward one another. These and numerous other variations and modifications of the apparatus of this invention will readily occur to those skilled in the art. Accordingly, the scope of this invention is not to be limited to the disclosed embodiments but is to include all such embodiments encompassed within the scope of the claims appended hereto.

We claim:

1. Concrete form panel tying apparatus for restraining outward movement of a concrete form panel with respect to a tie passing outwardly through a form opening in said form panel, said apparatus comprising:

a bearing member attachable to said form panel, said bearing member having an opening alignable with said form opening, and an outwardly facing first bearing surface, a tie extending through said bearing member opening, an outer end portion on said tie having a first transverse dimension, an inner end portion on said tie located inwardly of said outer end portion and having a second transverse dimension less than said first transverse dimension, an outwardly sloped tie surface extending between said outer end portion and said inner end portion, said outwardly sloped tie surface being arcuate in cross-section, anchoring means for engaging said tie, said anchoring means being adjustably positioned between said sloped tie surface and said first bearing surface to compensate for misalignment of the tie with respect to the bearing member and comprising a clamping member and a second bearing surface engageable with said first bearing surface, said clamping member having a clamping member recess of transverse dimension greater than said second transverse dimension and less than said first transverse dimension, said clamping member recess being defined by an outwardly sloped clamping surface of arcuate cross-section complementary to said tie surface and engageable therewith, said clamping member being movable radially with respect to said tie between a clamping position wherein said clamping surface is in engagement with said tie surface to restrain said concrete form panel against outward movement with respect to said tie and a nonclamping position wherein said clamping surface and said tie surface are not engaged with one another.

2. Concrete form panel tying apparatus according to claim 1 wherein said anchoring means further comprises a mounting member interposed between said clamping member and said bearing member and having an opening alignable with said form opening so that said tie extends therethrough, said clamping member being pivotally attached to said mounting member, and said second bearing surface being carried by said mounting member.

3. Concrete form panel tying apparatus according to claim 2 wherein said first bearing surface is concavely curved and said second bearing surface is convexly curved for engaging said concavely curved first bearing surface, whereby such engagement permits slight angular misalignment between the form panel and a tie clamped thereto without resulting imposition of substantial bending stresses on the tie.

4. Concrete form panel typing apparatus according to claim 2 wherein said first bearing surface is convexly curved and said second bearing surface is concavely curved for engaging said convexly curved first bearing surface, whereby such engagement permits slight angular misalignment between the form panel and a tie clamped thereto without resulting imposition of substantial bending stresses on the tie.

5. Conctete form tying apparatus according to claim 3 further comprising means flexibly joining said mounting member and said bearing member, and means operably associated with said bearing member for releaseably attaching said bearing member to the form panel.

6. Concrete form panel tying apparatus according to claim 2 further comprising an actuating member extending radially outwardly of said clamping member, whereby pivotal movement of said clamping member may be facilitated by use of said actuating member as a handle.

7. Concrete form panel tying apparatus according to claim 6 wherein said actuating member projects in a generally horizontal direction when said clamping member is in said clamping position and projects in a generally vertical direction when said clamping member is in said nonclamping position.

8. Concrete form panel tying apparatus according to claim 1 wherein said anchoring means comprises two said clamping members movable between said clamping position with the recesses of said clamping member generally mating and defining an aperture and an open nonclamping position.

9. Concrete form panel tying apparatus according to claim 8 wherein said recesses are generally semicircular, whereby the aperture defined thereby is generally circular.

10. Concrete form panel tying apparatus according to claim 8 further comprising means pivotally joining said clamping members, whereby said clamping members may be pivotally moved between said mating clamping position and said open nonclamping position.

11. Concrete form panel tying apparatus according to claim 10 further comprising linkage means operatively associated with said clamping members for joint pivotal movement of said clamping members.

12. Concrete form panel tying apparatus according to claim 11 wherein said linkage means further comprises an actuating handle for selectively moving said clamping members between said clamping position and said nonclamping position.

13. Concrete form panel tying apparatus according to claim 12 further comprising means operatively associated with said clamping members for releasably holding said clamping members together in said clamping position.

14. Concrete form panel tying apparatus according to claim 1 wherein said tie comprises an elongated member having a longitudinally central section tapering longitudinally from a third transverse dimension to a fourth and smaller transverse dimension, and having an outer section extending longitudinally outwardly of each end of said central section, said outer sections being axially aligned and one of said other sections being provided with threaded portions of transverse dimension not larger than said smaller transverse dimension in engagement with a threaded member for anchoring said tie to the form panel, said threaded member carrying said outer end portion, said inner end portion, and said outwardly sloped tie surface.

15. Concrete form panel tying apparatus according to claim 14 wherein said central section is internally threaded at said third transverse dimension and said one of outer sections is externally threaded to be screwed into said central section.

16. Concrete form panel tying apparatus according to claim 15 further comprising radially opposed flats formed in radially outermost portions of said one of said outer sections whereby said one of said outer sections may be gripped firmly for axial rotation by a wrench.

17. Concrete form panel tying apparatus according to claim 14 wherein the other of said outer sections of said tie comprises a threaded portion for engagement also with a threaded member for anchoring said tie to a form panel.

18. Concrete form panel tying apparatus according to claim 14 wherein said elongated member is of generally circular cross section.

19. Concrete form panel tying apparatus according to claim 14 wherein said fourth transverse dimension is not smaller than the transverse dimension of that one of said outer sections that is adjacent to that portion of said central section having said fourth transverse dimension.

20. Concrete form panel tying apparatus according to claim 14 wherein said fourth transverse dimension and a transverse dimension of the outer section adjacent the fourth transverse dimension central section portion are substantially equal.

21. Concrete form panel tying apparatus according to claim 14 wherein said sloped tie surface is convexly curved.

22. Concrete form panel tying apparatus according to claim 1 further comprising releasable locking means for operatively associated with said clamping member securing said clamping member in said clamping position.

23. Concrete form panel tying apparatus according to claim 1 further comprising means operatively associated with said clamping member for selectively and alternatively holding said clamping member in either said clamping position or said nonclamping position.

24. Concrete form panel tying apparatus according to claim 1 wherein said clamping surface is concave and said tie surface is convex for mating engagement with said clamping surface, whereby such engagement between said tie surface and said clamping surface permits slight angular misalignment between the form panel and such a tie clamped thereto without resulting imposition of substantial bending stresses on the tie.

25. Concrete form panel tying apparatus according to claim 24 wherein said clamping member recess is located at the inner end of a slot extending inwardly of one edge of said clamping member, said slot being of sufficient width to accommodate said inner end portion of said tie and having an open slot end, said recess generally conforming to the cross-sectional configuration of said inner end portion of said tie.

26. Concrete form panel tying apparatus according to claim 25 wherein said inner end of said slot is of generally circular cross section and said recess is generally semicircular.

27. Concrete form panel tyng apparatus according to claim 26 wherein said clamping member portion adjacent said slot and said recess comprises a surface inclined longitudinally outwardly of said bearing member from said open slot end toward said recess, whereby longitudinally outward force may thereby be exerted on the tie when the clamping member is moved from its nonclamping position to its clamping position and may readily be released upon initiation of movement of the clamping member toward its nonclamping position.

28. Concrete form panel tying apparatus according to claim 27 wherein said clamping member comprises a wedge shaped member slidable transversely of said tie and wherein said inclined surface adjacent said slot corresponds generally to the inclined surface of the wedge.

29. Concrete form panel tying apparatus according to claim 23 wherein, the first bearing surface of said bearing member is inclined in a direction opposite said inclined surface adjacent said slot and at an angle generally equal thereto.

30. Concrete form panel tying apparatus according to claim 1 wherein said tie comprises an elongated member having a longitudinally central section with flanking outer sections extending outwardly therefrom, each of said outer sections comprising an outer end portion, an inner end portion and an outwardly slope surface extending therebetween.

31. Concrete form panel tying apparatus according to claim 30 further comprising said tie central section tapering longitudinally from a third transverse dimension to a fourth and smaller transverse dimension.

32. Concrete form panel tying apparatus according to claim 30 wherein said outer sections are releasably attached to said central section by means of interacting threaded portions on said outer sections and said central section.

33. Concrete form panel tying apparatus according to claim 1 wherein said anchoring means further comprises means for pivotally attaching said clamping member to said bearing member, whereby said clamping member may move pivotally between its clamping position and its nonclamping position.

34. Apparatus for anchoring a concrete form panel to an elongated tie to restrain outward relative movement of the panel with respect to the tie, said anchoring apparatus comprising:

a load bearing member attachable to the outside of the form panel and having an opening through which said tie is extendable, a clamping member releasably clampingly engageable with a portion of said tie that is extending outwardly through said opening, and a mounting member attached to said clamping member and havng a second opening through which said tie is extendable, said mounting member being interposed between said bearing member by adjustable attaching means, whereby adjustment between the clamping member and the bearing member is facilitated to compensate for misalignment of the tie with respect to the bearing member.

35. Anchoring apparatus according to claim 34 wherein the portion of said bearing member engaging said mounting member comprises a convexly curved surface.

36. Anchoring apparatus according to claim 35 wherein the portion of said mounting member engaging said bearing member comprises a concavely curved surface generally corresponding in curvature to said bearing member convexly curved surface, whereby the engagement between said bearing member and said mounting member is of the nature of a ball and socket to facilitate the misalignment compensation.

37. Anchoring apparatus according to claim 35 wherein said convexly curved surface comprises a spherically convexly curved surface.

38. Anchoring apparatus according to claim 34 wherein said adjustable attaching means comprises a spring member extending between said bearing member and a portion of said mounting member, whereby the spring may urge the mounting member into alignment with the bearing member while permitting movement therebetween to compensate for misalignment between an engaged tie and the bearing member.

39. Anchoring apparatus according to claim 34 further comprising means limiting the amount of adjustment between said mounting member and said bearing member.

* * * * *

UNITED STATES PATENT AND TRADEMARK OFFICE

CERTIFICATE OF CORRECTION

PATENT NO. : 4,044,986

DATED : August 30, 1977

INVENTOR(S) : James K. Strickland et al.

It is certified that error appears in the above—identified patent and that said Letters Patent is hereby corrected as shown below:

Column 14, line 37, after "said" insert -- clamping member and said bearing member and being attached to said --.

Signed and Sealed this

*Eighth* Day of *July 1980*

[SEAL]

*Attest:*

SIDNEY A. DIAMOND

*Attesting Officer*

*Commissioner of Patents and Trademarks*